United States Patent [19]

Loughlin

[11] 4,431,220

[45] Feb. 14, 1984

[54] SAFETY RELEASE FOR BAR LOCK

[76] Inventor: Robert W. Loughlin, 1261 Rahway Rd., Scotch Plains, N.J. 07076

[21] Appl. No.: 279,858

[22] Filed: Jul. 2, 1981

[51] Int. Cl.[3] ..... E05C 15/02

[52] U.S. Cl. ..... 292/340; 292/DIG. 65

[58] Field of Search ..... 292/251, 340, DIG. 44, 292/DIG. 71, DIG. 65

[56] References Cited

U.S. PATENT DOCUMENTS

| | | | |
|---|---|---|---|
| 2,461,426 | 2/1949 | King | 292/340 |
| 2,636,767 | 4/1953 | Groeger | 292/341.18 |
| 2,746,782 | 5/1956 | Schamotta | 292/251 X |
| 2,784,022 | 3/1957 | North et al. | 292/336.3 |
| 2,823,940 | 2/1958 | Squire | 292/92 |
| 3,120,032 | 2/1964 | Burnette | 20/16 |
| 3,346,286 | 10/1967 | Wescott | 287/189.36 |
| 3,871,694 | 3/1975 | White | 292/92 |
| 4,099,754 | 7/1978 | Hoebing | 292/251 X |

*Primary Examiner*—Richard E. Moore

*Attorney, Agent, or Firm*—Ratner & Prestia

[57] ABSTRACT

A locking bar assembly having a secondary safety release mechanism that includes a shaft that is removably engaged with and coupled to a strike plate cover of the locking bar assembly. The strike plate cover rigidly engages and secures in position a strike plate of the locking bar assembly. When the safety release mechanism is operated, the shaft is rotated to disengage and decouple from the strike plate cover thereby releasing the strike plate of the locking bar assembly and releasing the locking bar assembly.

5 Claims, 4 Drawing Figures

SAFETY RELEASE FOR BAR LOCK

BACKGROUND OF THE INVENTION

A. Field of the Invention

This invention relates to the field of locking systems and in particular to a safety release mechanism for removably engaging a locking bar assembly.

B. Background Art

Bar lock assemblies having a pair of strike plates with alignable lugs are known in the art. Other types of locks exhibit various types of safety release mechanisms whereby one could, while locked in a room, unlock or release the actual locking mechanism that is mounted on the wall or door outside the locked room. Many of these safety release mechanisms or unlocking devices were quite complex and costly and worked directly on the lock itself or its conventional retainer. For example, as shown by U.S. Pat. No. 3,871,694, a seal assembly or conventional retainer was released. Such prior safety releases operated the lock mechanism or the strike plate of the lock assembly which had the disadvantage of not being protected from external shearing forces.

SUMMARY OF THE INVENTION

A secondary safety release mechanism for releasably coupling a locking bar assembly to a section element which has at least one strike plate that has at least one opening. A strike plate cover is formed for mounting directly over and substantially encompassing the strike plate on one side of the section element. The strike plate cover has one concealed opening for the purpose of receiving a rotatable safety release shaft that passes through the section element from the side opposite the cover and removably engages with and couples to the concealed opening in the cover. The shaft passes through the section element and subsequently through at least one opening of the strike plate and is received by the concealed opening of the cover. The shaft is threaded and is screwed into the concealed opening. The shaft is made to be unscrewed from the strike plate cover thereby allowing the cover to fall away from the locking assembly preventing the locking bar assembly from constraining the movement of the opposing section elements. The opposing section elements may consist of one hinged swinging door and one wall member or one slidable door and a wall member.

DESCRIPTION OF THE PREFERRED EMBODIMENT

Figure 1:
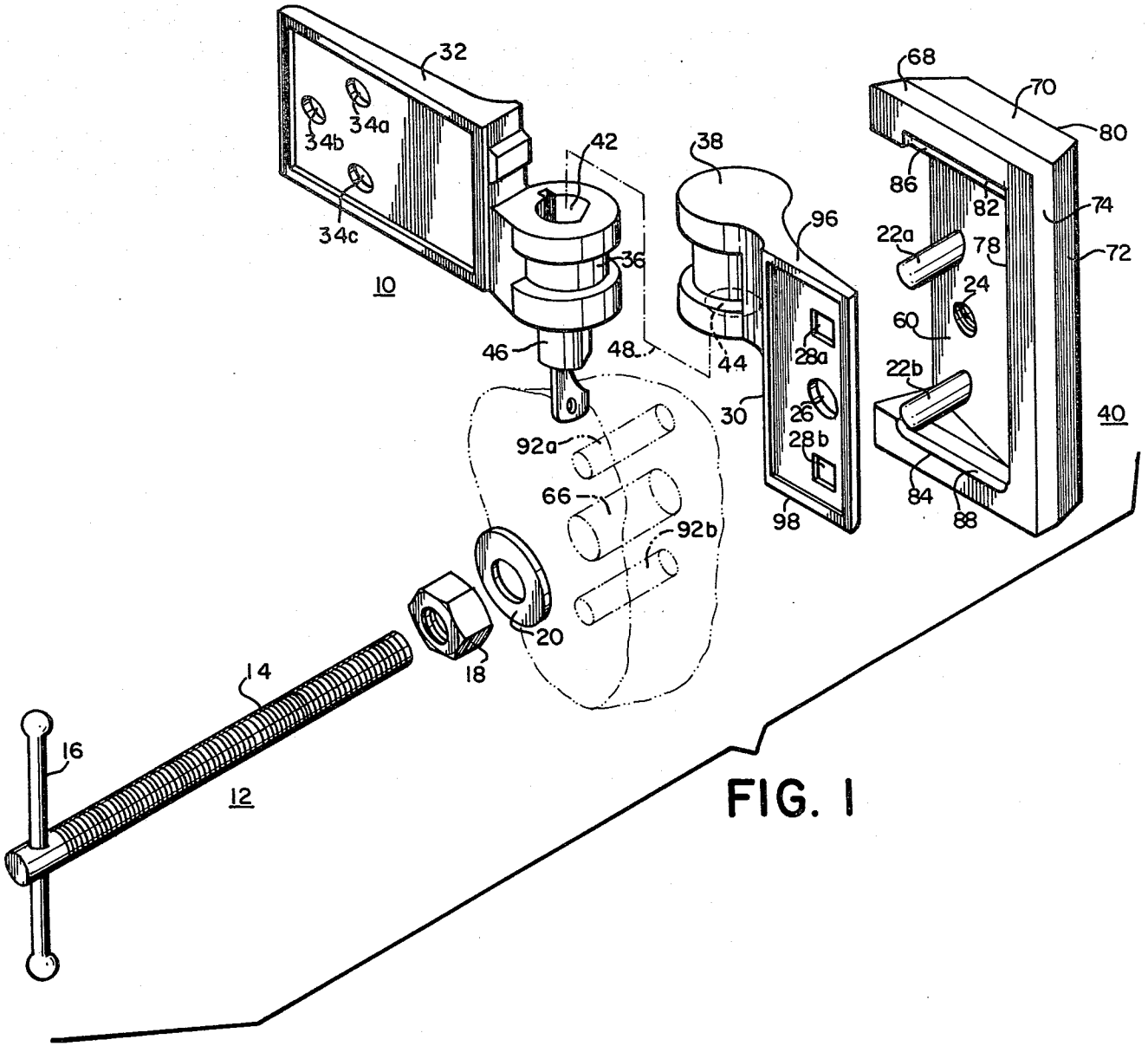
FIG. 1 is an exploded view of the components of a locking bar assembly and the secondary release mechanism embodied in the invention.
Figure 2:
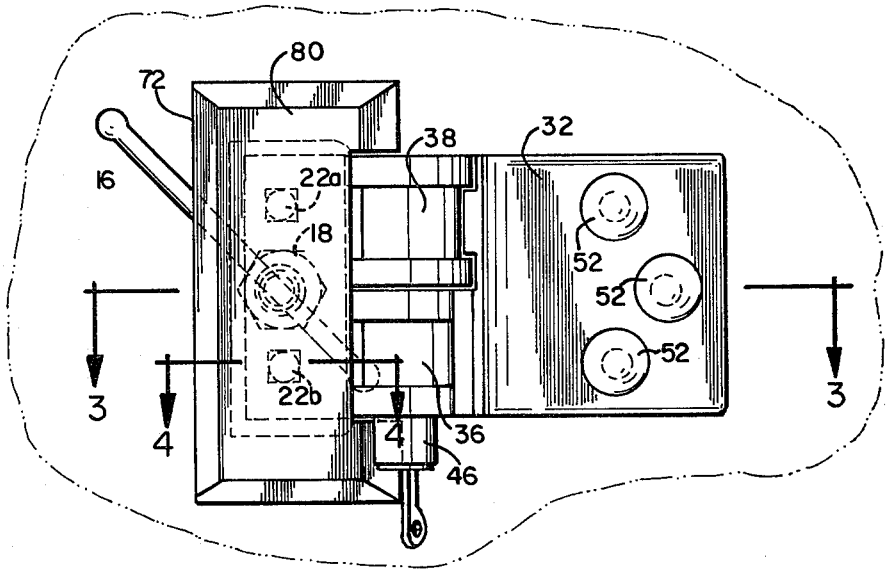
FIG. 2 is a front view of the bar lock assembly of FIG. 1 showing the position of the secondary release mechanism in relation thereto.

Referring to FIG. 1, there is shown bar lock assembly 10 and secondary safety release means 12. Bar lock assemblies, have been described in U.S. Pat. Nos. 3,827,266; 3,899,905; 3,940,957 and 3,921,422, which are incorporated herein by reference.

Figure 3:
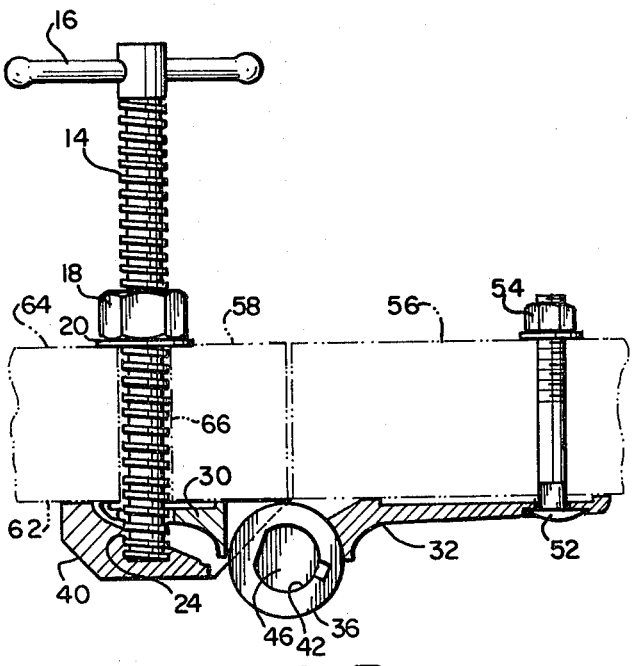
FIG. 3 is a top view of the bar lock assembly and secondary release mechanism of FIG. 2 taken along line 3—3.
Figure 4:
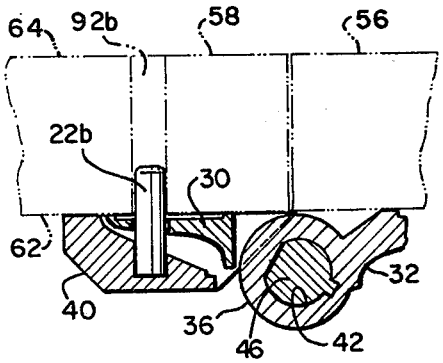
FIG. 4 is a top view of the bar lock assembly and locator stud of FIG. 2 taken along line 4—4.

Safety release mechanism 12 has a handle 16 attached to a release shaft 14 which passes through, first, nut 18 and, second, washer 20. In this embodiment of the invention, release shaft 14 is cylindrically shaped and threaded and has, movably attached at one end, a handle 16 provided for turning shaft 14. Lock assembly 10 has first strike plate 32 substantially formed in an "L" shaped configuration having lug member 36 formed thereon. Lug member 36 has a bore 42 for receiving a bar lock mechanism 46. Strike plate 32 has a plurality of openings, 34*a*, 34*b* and 34*c*, through which bolts 52 may be received for the purpose of rigidly securing the strike plate to a first section element 56 as shown in FIG. 3. Section element 56 may be a hinged door, for example.

Lock assembly 10 also has second strike plate 30 substantially formed in an "L" shaped configuration having lug member 38 formed thereon. Lug member 38 has a partial bore 44 for receiving a portion of bar lock mechanism 46. Strike plate 30 has a plurality of aperatures 26, 28*a*, 28*b* at least one of which is large enough to receive release shaft 14.

Strike plate 30 is rigidly secured to a second section 58 which may be a wall element, by a strike plate cover 40. Cover 40 is a geometrical, solid structure formed of a substantially rectangular shaped solid base portion 68 with a trapezoidal quadrilateral top portion 70. The substantially rectangular shaped base surface 74 of base portion 68 has a section removed from it that is smaller dimensionally than the size of said rectangular base surface. The shape of base 74 resembles an inverted "C". The interior portion of said geometrical solid structure 72 or strike plate cover 40, generally within the area enveloped by the "C", ramps downwardly from the back side 78 of the "C" shaped base surface 74 to within close proximity to the top 80 of trapezoidal top portion 70 forming inner surface 60.

At the top and bottom portions, 82 and 84 respectively, of the inverted ∂C" shaped base surface 74 are shelves, 86 and 88 respectively, that lie parallel to but slightly below base surface 74. When the cover 40 is placed over plate 30, shelf 86 receives edge 96 of said plate and shelf 88 receives edge 98 of said plate such that when shaft 14 is tightly screwed into opening 24, cover 40 will fit tightly and securely to plate 30. All three edges, 96, 97 and 98, and plate top surface 99, having aperatures 28*a*, 28*b* and 26 are covered and concealed entirely by strike plate cover 40. Upon screwing shaft 14 to the depth of concealed opening 24, cover 40 becomes substantially flush against section 58. By covering the strike plate entirely and by abutting section 58, strike plate cover 40 inhibits external attempts at prying open the cover or any underlying portion of said lock assembly.

Strike plate cover 40 forms a part of lock assembly 10. A plurality of stud locators or guide pins 22*a*, 22*b* are rigidly secured to and extend outwardly from inner surface 60 and perpendicular to base surface 74 and are positioned to be received by strike plate aperatures 28*a*, 28*b* respectively. Inner surface 60 also has therein a threaded opening 24 formed to threadedly engage with shaft 14.

Guide pins 22*a* and 22*b* prevent torque or shearing forces from acting directly on the bar lock 10 since such forces and stresses are in the main transmitted to the guide pins which are snugly positioned within passageways 92*a* and 92*b* thereby preventing rotational motion and providing structural rigidity and integrity to the assembly. The guide pins, 22*a* and 22*b*, also alleviate the shear stresses that would be placed on the safety release mechanism 12 as external forces act upon cover 40 specifically and lock assembly 10 generally.

In locking assembly 10, each of strike plates 32, 30 is mounted to movable section elements 56, 58 respectively. Section element 56, for example, may be a door member and section element 58 may be a wall member. Strike plate 32 is mounted to one side of section element 56 through a plurality of bolts, screws or some like mechanism represented by openings 34*a*, 34*b*, and 34*c*. Then strike plate 30 is positioned on a first side 62 of section element 58 by aligning stud locators 22*a* and 22*b*, of cover plate 40 within respective aperatures 28*a* and 28*b* of plate 30 and passageways 92*a*, 92*b* which pass through section element 58. Aperature 26 is positioned approximately midway between aperatures 28*a,b* to receive said shaft which passes through said second section element from a second side 64. After strike plate cover is positioned about said second strike plate and stud locators are received by said aperatures of said strike plate then shaft is threaded in opening 24 of said strike plate cover. As shown clearly in FIG. 3, safety release shaft 14 can removably secure said second strike plate and said strike plate cover tightly against side 62 of section element 58 by providing nut 18 and washer 20 for shaft 14 to pass through prior to entering passageway 66 on second side 64 of second section element 58.

The locking bar assembly can be unfastened from the side 64 of section element 58 by disengaging and decoupling shaft 14 from the strike plate cover. The disengagement of the shaft 14 occurs by unscrewing shaft 14 from the opening 24. Once the shaft 14 has been completely disconnected from the inner surface 60 of strike plate cover 40, the strike plate cover will fall away from first side 62 of section element 58. For example, if section element was a hinged swinging door it would have to be pushed open forcing the strike plate cover to fall away from the locking assembly thereby unfastening the locking bar assembly 10 and preventing the locking assembly from constraining the door movement. Of course, strike plate 32 remains locked to the strike plate 30.

In a further embodiment, springs with relatively small moduli of elasticity may be laced around each of the locator studs 22*a,b*. The purpose of the springs is to exert a force against strike plate cover 40 so that when shaft 14 is disengaged, cover 40 is forced to fall away from assembly 10. This is particularly important if a sliding door is used instead of the swinging door previously described. Each of such springs (not shown) may have a noncompressed length at least equal to the length of studs 22*a,b*. The springs may be disposed within openings 92*a,b* respectively, which have been enlarged to receive the springs of sufficient depth to provide for the necessary length of the spring. In this way, there is formed a shelf in each of the openings to support the respective ends of the springs. In addition, openings 28*a,b* would be enlarged to allow the springs to pass therethrough. In a still further embodiment, it will be understood that cover 40 may cover and conceal first strike plate 32 instead of strike plate 30.

What is claimed is:

1. A secondary safety release means releasably coupling a locking bar assembly to a section element having at least one strike plate with at least one opening comprising:

(a) a strike plate cover mounting over said strike plate on a first side of a section element, said cover having a concealed opening; and (b) a rotatable safety release shaft that passes through said opening in said strike plate from a second side of said section to removably engage with and couple to said concealed opening for releasing said cover from said locking bar assembly.

2. A secondary release means as recited in claim 1 wherein said strike plate cover includes at least one guide pin received by at least one of said openings in said strike plate.

3. A secondary release means as recited in claim 1 or 2 wherein said section element includes an opening for receiving said guide pin for preventing (1) rotational motion of said assembly and (2) shearing forces from acting directly on said strike plate.

4. A secondary release means as recited in claim 2 wherein said strike plate cover covers substantially all of said strike plate.

5. A secondary release means as recited in claims 1 or 2 wherein said shaft is a threaded shaft received by said concealed opening which is a threaded opening.

* * * * *